US005448952A

United States Patent [19]

Hung

[11] Patent Number: 5,448,952

[45] Date of Patent: Sep. 12, 1995

[54] DOOR DRIVING MECHANISM

[76] Inventor: Gin-Shan Hung, No. 56, Hsin Gong Road, Sheng Gang Hsiang, Chang Hua, Taiwan

[21] Appl. No.: 214,137

[22] Filed: Mar. 17, 1994

[51] Int. Cl.[6] ..... B61K 7/00

[52] U.S. Cl. ..... 104/251; 104/249; 105/96; 105/101; 105/108; 105/113; 105/133

[58] Field of Search ..... 105/96, 96.1, 97, 98, 105/101, 102, 104, 108, 110, 112, 113, 114, 73, 133; 104/249, 251; 160/188, 201, 138; 49/358

[56] References Cited

U.S. PATENT DOCUMENTS

| | | | |
|---|---|---|---|
| 478,138 | 7/1892 | Sperry | 105/101 |
| 634,807 | 10/1899 | Dinkelberg | 105/113 |
| 801,602 | 10/1905 | Moss | 105/101 |
| 896,226 | 8/1908 | Miller et al. | 105/101 |
| 993,589 | 5/1911 | Eaton | 105/113 |
| 1,075,178 | 10/1913 | Wehner | 105/101 |
| 1,660,475 | 2/1928 | Carter | 105/101 |
| 4,799,431 | 1/1989 | Edwards et al. | 105/96 |

FOREIGN PATENT DOCUMENTS

| | | | |
|---|---|---|---|
| 0885775 | 8/1953 | Germany | 104/249 |

*Primary Examiner*—Mark T. Le
*Attorney, Agent, or Firm*—Charles E. Baxley

[57] ABSTRACT

A driving mechanism is disposed in the bottom of a door for driving the door and includes a reduction gearing and a motor fixed to the door, and a gear coupled to the reduction gearing and engaged with two shafts for rotatably supporting the wheels of the door so as to apply a downward force to the pinions in order to prevent the wheels moving upward away from the tracks. A retaining device is fixed to one of the tracks or fixed to the ground and has an opening for engaging with one of the pinions so as to maintain the door in place.

1 Claim, 6 Drawing Sheets

DOOR DRIVING MECHANISM

BACKGROUND OF THE INVENTION

1. Field of the Invention

The present invention relates to a driving mechanism, and more particularly to a door driving mechanism.

2. Description of the Prior Art

A typical door driving mechanism is shown in FIGS. 7 and 8 and is provided for driving a door, for example, as shown in FIG. 6, the door 50 includes a number of wheels 51 rotatably engaged on a pair of tracks 52 and includes a number of door frames coupled together by a lazy tong construction 53, the typical door driving mechanism comprises a plate 54 fixed in the lower portion of one end of the door 50, a reduction gearing 55 and a motor 56 disposed on the plate 54, a sprocket 57 connected to the reduction gearing 55, a pair of wheels 60 rotatably secured to the plate 54 by a shaft 61, and another sprocket 59 fixed on the shaft 61 and coupled to the sprocket with a chain 58, the wheels 60 are rotated by the motor 56 via the chain 58 and the sprockets 57, 59. However, in operation, the chain 58 applies an upward pulling force to the sprocket 59 such that the wheels 60 may also be slightly pulled upward away from the tracks the frictional force between the wheels 60 and the tracks 52 will thus be reduced such that the door can not be stably driven by the motor. In addition, when the door is closed, no lock devices are provided for retaining the door in the closed position, the wheels 51, 60 may easily slide along the tracks 52 when the door is pushed.

The present invention has arisen to mitigate and/or obviate the afore-described disadvantages of the conventional door driving mechanisms.

SUMMARY OF THE INVENTION

The primary objective of the present invention is to provide a door driving mechanism with which the door can be stably and solidly moved.

The other objective of the present invention is to provide a door driving mechanism which includes a lock device for locking the door in the closed position.

In accordance with one aspect of the invention, there is provided a driving mechanism for a door having at least two pairs of wheels rotatably engaged on a pair of tracks respectively, the two pairs of wheels being coupled together by two shafts respectively, the driving mechanism comprising a reduction gearing and a motor for fixing to the door, two pinions for fixing to the shafts respectively, and a gear coupled to the reduction gearing and engaged with the pinions, the gearing including an axle arranged above the pinions for applying a downward force to the pinions so as to prevent the wheels moving upward away from the tracks.

A retaining device is further provided for securing to the tracks, the retaining device including an opening for engaging with one of the pinions and including at least one tooth formed in the opening for engaging with the pinion, whereby, the door is maintained in place by engagement between the pinion and the tooth.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
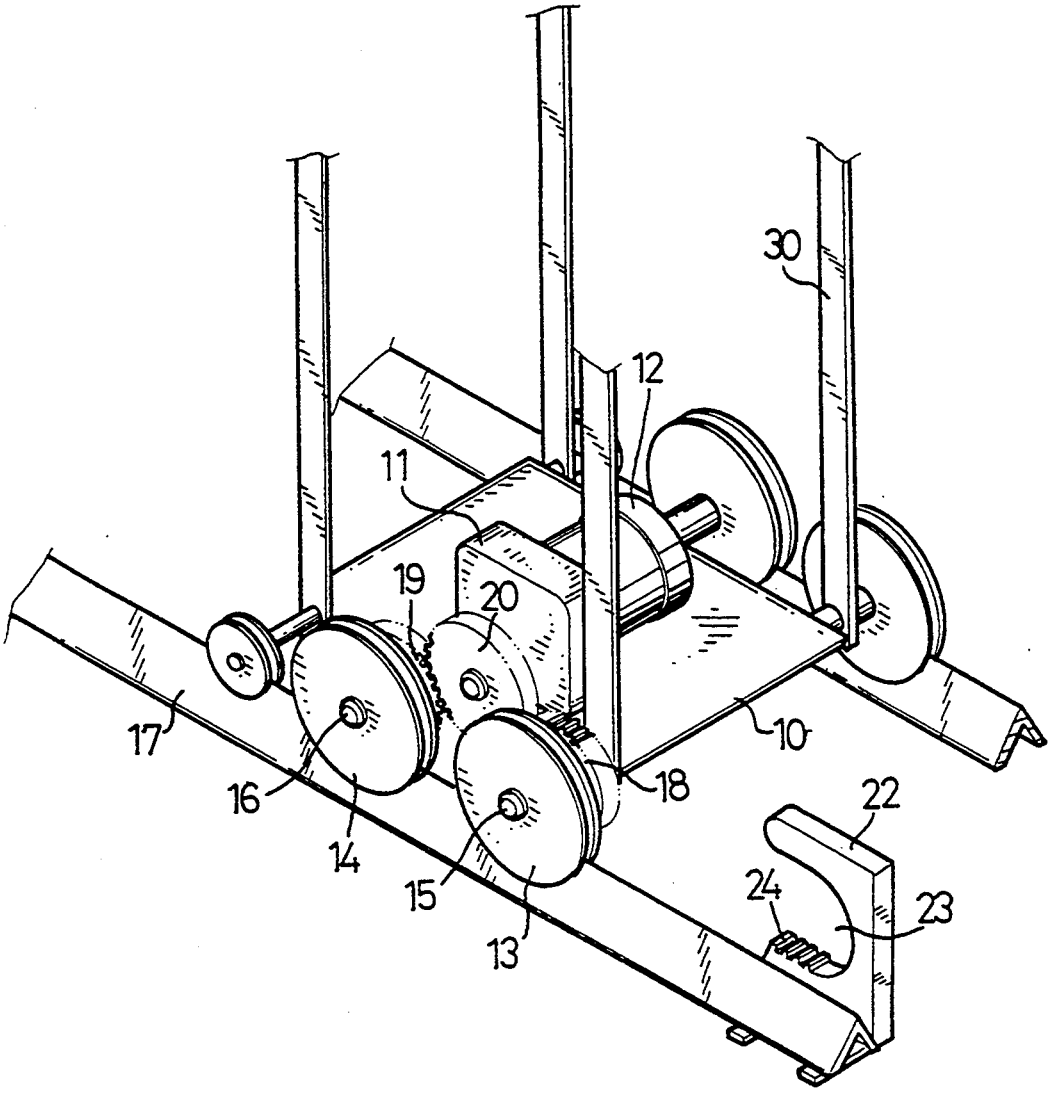
FIG. 1 is a perspective view of a door driving mechanism in accordance with the present invention.
Figure 2:
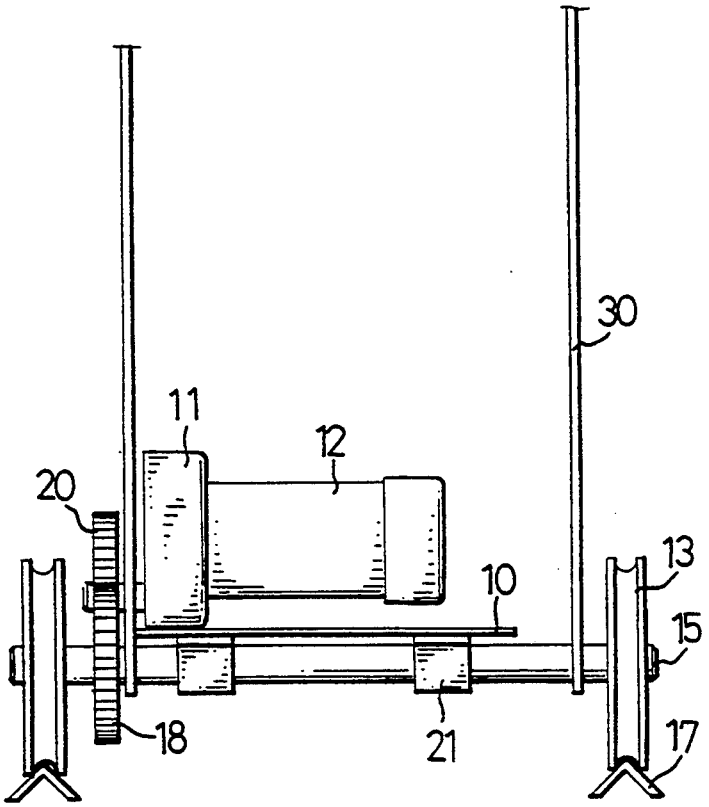
FIG. 2 is an end view of the door driving mechanism.

Referring to the drawings, and initially to FIGS. 1 and 2, a door driving mechanism in accordance with the present invention comprises a number pairs of wheels 13 secured to the bottom portion of a door 30 by a number of shafts 15 and rotatably engaged on a pair of tracks 17, a plate 10 fixed on the bottom portion of the door 30 and including a number of tubes 21 for engaging with the shafts 15, a reduction gearing 11 and a motor 12 disposed on the plate 10, a gear 20 coupled to the reduction gearing 11, another pair of wheels 14 rotatably secured to the plate 10 by a shaft 16, a pinion 18 secured on one of the shafts 15 and another pinion 19 secured on the shaft 16 for engaging with the gear 20, it is preferable that the axle of the gear 20 is arranged above the shafts 15, 16.

Figure 3:
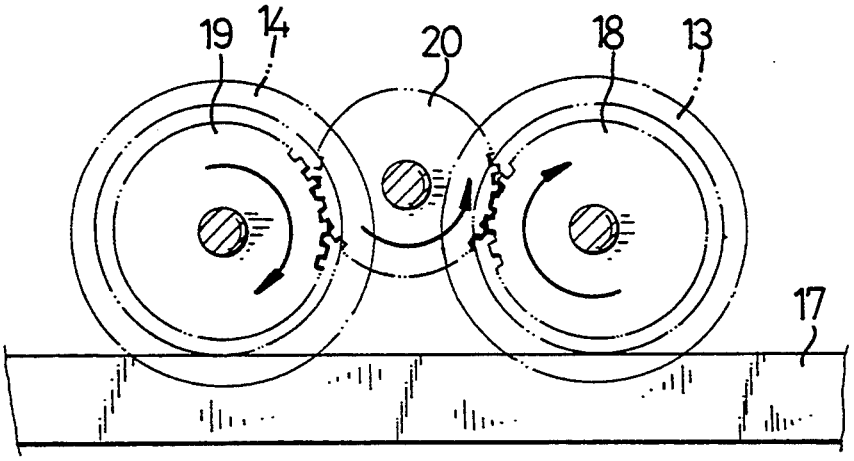
FIG. 3 is a schematic view illustrating the gearing of the door driving mechanism.

In operation, the gear 20 is engaged with the pinions 18, 19 (FIG. 3) and applies a downward force to the pinions 18, 19, or at least, the pinions 18, 19 will not be pulled upward by the gear 20, such that the wheels 13, 14 will not move upward away from the tracks 17, whereby, the wheels 13, 14 may solidly engage with the tracks 17 and the door can be stably and solidly moved by the driving mechanism without slipping.

Figure 4:
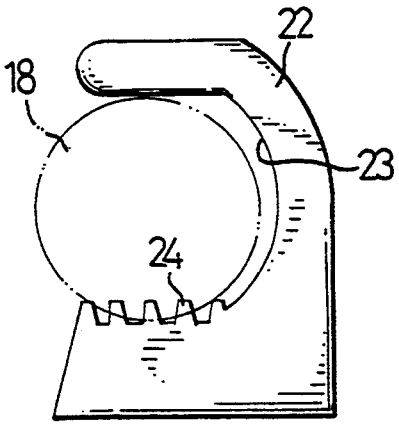
FIG. 4 is a plane view illustrating the lock device of the door driving mechanism.

As shown in FIGS. 1 and 4, a retaining device 22 is fixed on one end of one of the tracks 17 and includes an opening 23 formed therein for receiving the pinion 18, and at least one tooth 24 provided in the bottom of the opening 23 for engaging with the pinion 18, the pinion 18 is engaged in the opening 23 and engaged with the tooth 24 when the door is closed, such that the door can not be opened and can thus be locked.

Figure 5:
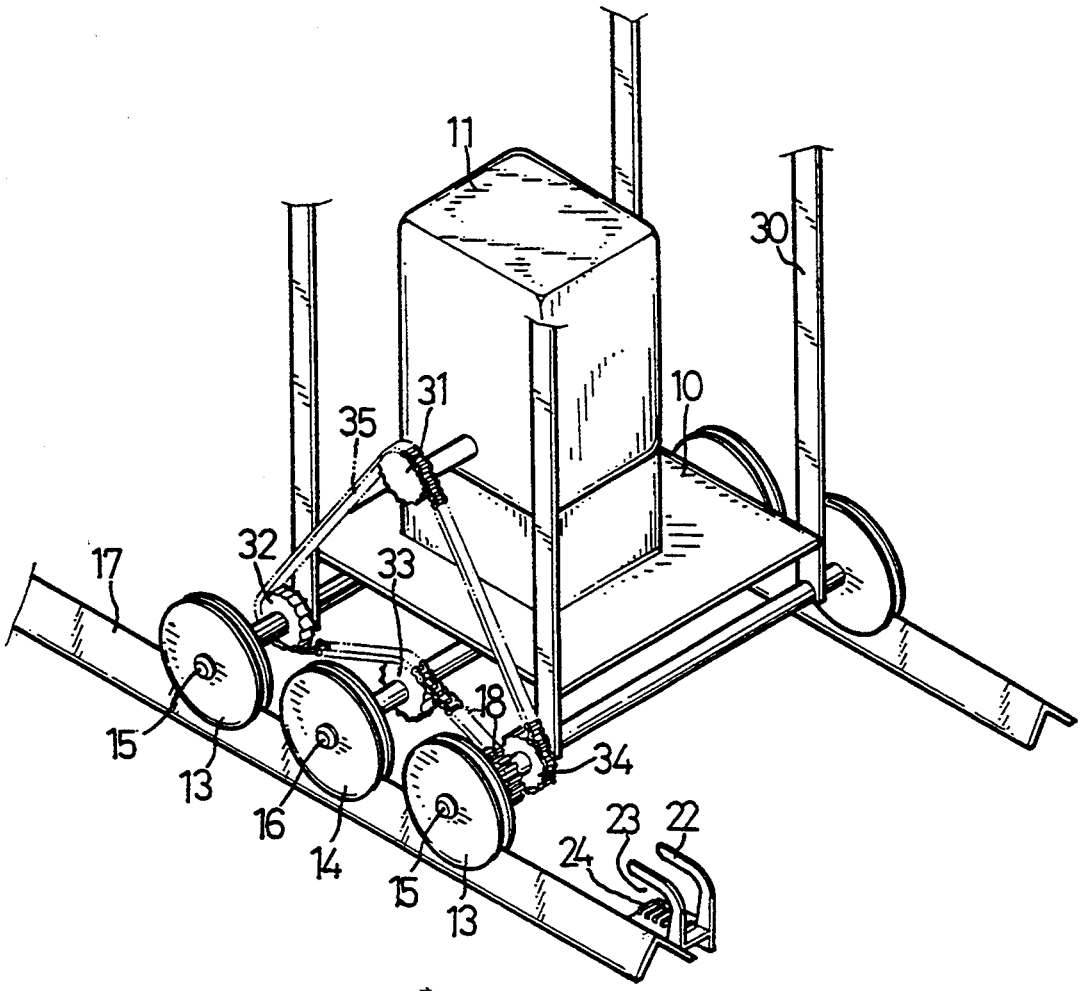
FIG. 5 is a perspective view illustrating another application of the door driving mechanism.
Figure 6:
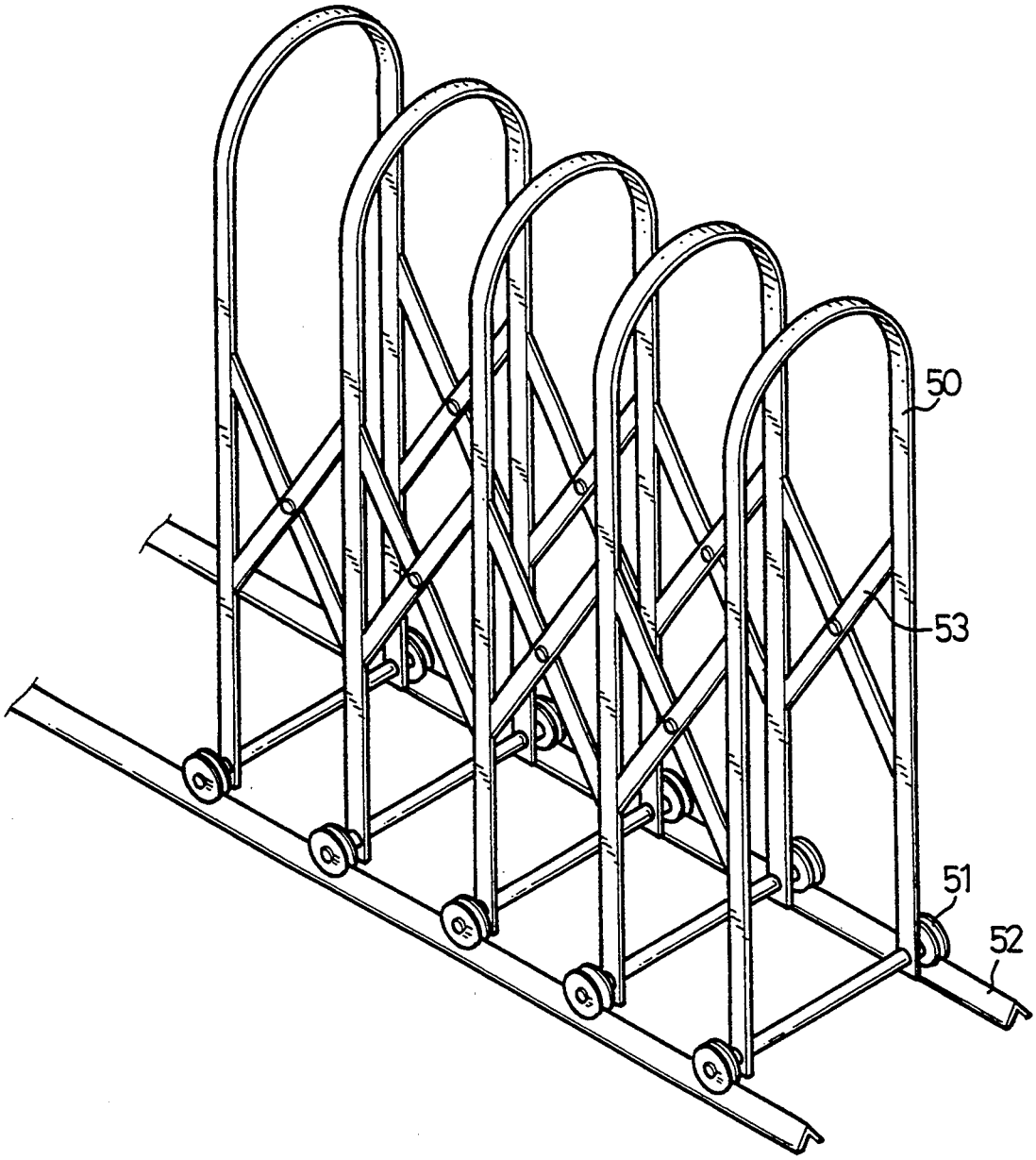
PRIOR ART Fig 6
FIG. 6 is a perspective view of a typical door.
Figure 7:
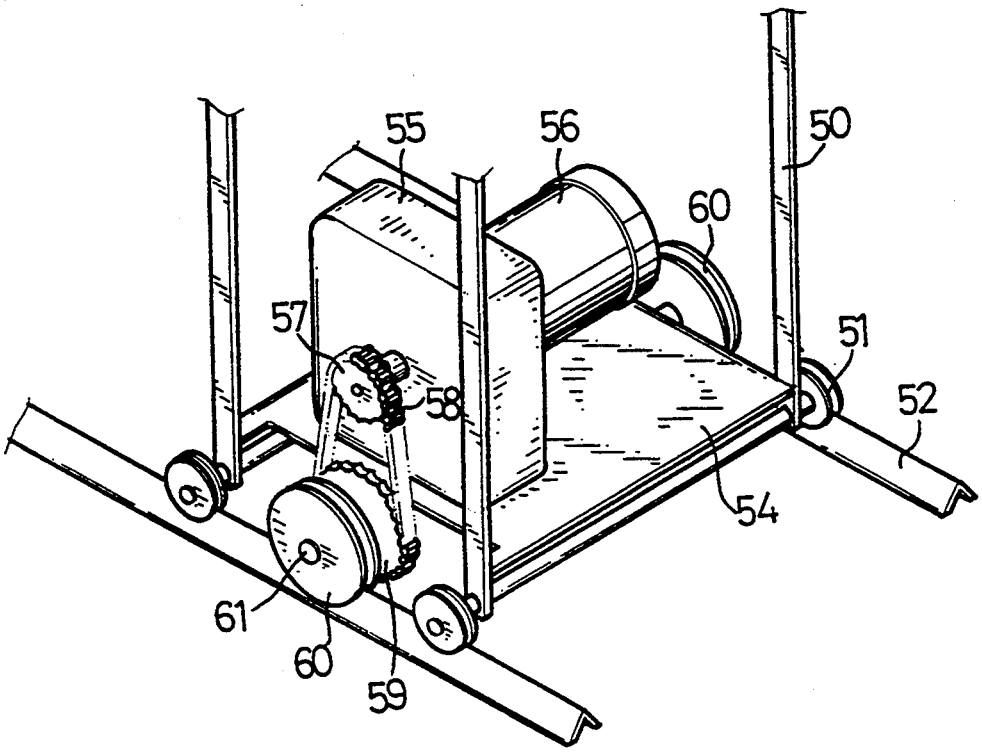
PRIOR ART Fig 7
FIG. 7 is a perspective view of a typical door driving mechanism.
Figure 8:
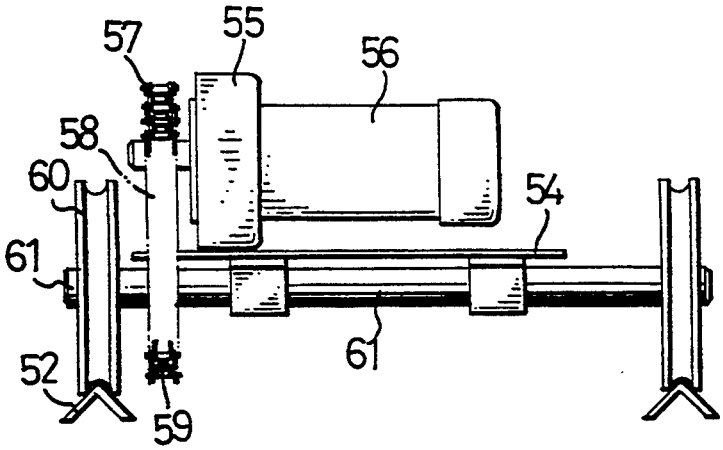
PRIOR ART Fig 8
FIG. 8 is an end view of the typical door driving mechanism.

As shown in FIG. 5, the driving mechanism may include a sprocket 31 secured to the reduction gearing 11, three other sprockets 32, 33, 34 fixed on three shafts 15, 16 and a chain 35 coupled with the sprockets 31, 32, 33, 34, in which the sprocket 33 is disposed between the sprockets 32, 34 and the chain 35 applies a downward force to the sprocket 33 such that the wheels 14 may solidly engage with the tracks 17 and the door may be solidly moved without slipping.

Accordingly, the door driving mechanism includes at least one pair of wheels that can be maintained in solid engagement with the tracks such that the door can be solidly moved.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving mechanism for a door having at least two pairs of wheels rotatably engaged on a pair of tracks respectively, said two pairs of wheels being coupled together by two shafts respectively, a reduction gearing and a motor for fixing to said door, two pinions for fixing to said shafts respectively, a gear coupled to said reduction gearing and engaged with said pinions, said gear including an axle arranged above said pinion for applying a downward force to said pinions so as to prevent said wheels from moving upward away from said tracks, and a retaining device for securing to said tracks, said retaining device including an opening for engaging with one of said pinions and including at least one tooth formed in said opening for engaging with said pinion whereby said door is maintained in place by engagement between said pinion and said tooth.

* * * * *